US006374574B1

(12) United States Patent
Onishi

(10) Patent No.: US 6,374,574 B1
(45) Date of Patent: Apr. 23, 2002

(54) TITLE SHEET INSERTING MACHINE

(75) Inventor: Toshiyuki Onishi, Kyoto (JP)

(73) Assignee: Kyoto Seisakusho Co., Ltd., Kyoto (JP)

( * ) Notice: Subject to any disclaimer, the term of this patent is extended or adjusted under 35 U.S.C. 154(b) by 0 days.

(21) Appl. No.: 09/384,491

(22) Filed: Aug. 27, 1999

(30) Foreign Application Priority Data

Jul. 19, 1999 (JP) ..... 11-204384

(51) Int. Cl.[7] ..... B65B 5/00
(52) U.S. Cl. ..... 53/238; 53/252
(58) Field of Search ..... 53/238, 237, 240, 53/139.5, 206, 252, 254, 474, 377.6

(56) References Cited

U.S. PATENT DOCUMENTS 4,685,277 A 8/1987 Ilsemann
4,881,356 A 11/1989 Beezer et al.
5,207,050 A 5/1993 Fulkerson et al.
5,285,620 A 2/1994 Kaye et al.
5,788,114 A * 8/1998 Perego ..... 53/468
5,816,028 A 10/1998 Zaniboni
5,943,845 A * 8/1999 Ilsemann ..... 53/468
6,233,909 B1 5/2001 Onishi

FOREIGN PATENT DOCUMENTS

EP 0 552025 7/1993
JP 2001-48118 2/2001

* cited by examiner

*Primary Examiner*—Scott A. Smith
*Assistant Examiner*—John Paradiso
(74) *Attorney, Agent, or Firm*—W. F. Fasse; W. G. Fasse

(57) ABSTRACT

A title sheet inserting machine includes a space forming mechanism that bends an optical disk case body from the developed, upwardly facing condition into a flat inverted V-shape, thereby deforming the transparent cover sheet of the case into a flat general V-shape through its own weight, to form an insertion space for inserting a title sheet between the case body and the transparent cover sheet. The title sheet inserting machine further includes an upper mold that has a corrugated contact face with a plurality of apertures for suction of air or ejection of compressed air to attach or detach the title sheet and that is insertable into the insertion space formed by the space forming mechanism, and a lower mold that has a corrugated contact face with a corrugation corresponding to that of the corrugated contact face of the upper mold, and that is positioned opposite the upper mold while being movable toward and away from the upper mold.

5 Claims, 8 Drawing Sheets

TITLE SHEET INSERTING MACHINE

BACKGROUND OF THE INVENTION

The present invention relates to the field of automated packaging and labeling, and more specifically, to a title sheet inserting machine for insertion of a flexible title sheet with visual information into a plastic case in which an optical disk such as CD (i.e. Compact Disk), DVD (i.e. Digital Video Disk) or the like is loaded.

One type of known case used for optical disks has a case body and a transparent cover sheet, both ends of which are bonded to the front surface side of the case body. A title sheet showing visual information relating to the contents of the optical disk is inserted into the space between the front surface of the case body and the transparent cover sheet.

Generally, the transverse width of a title sheet is nearly equal to that of the transparent cover sheet. Therefore, when a person tries to insert a title sheet into the transparent cover sheet, both ends of the title sheet interfere with both ends of the transparent cover sheet and the title sheet cannot be smoothly inserted into the transparent cover sheet.

The solution to this problem is identified in Japanese Patent No. 2857808. As shown in this Japanese patent, an indication sheet inserting machine comprises an opening and closing apparatus to support a case body openably and closably, and an indication sheet inserting apparatus provided against the opening and closing apparatus. The opening and closing apparatus includes a supporting rod to support the case body in the semi-open condition, a reversing device to reversely open the case body supported by the supporting rod in order to deform the case body into the flat V-shape, and a suction device to catch and lift the transparent sheet of the case body. The indication sheet inserting apparatus includes a bending device to bend the indication sheet in the corrugated form, and a transfer device to transfer the indication sheet, deformed in the corrugated form by the bending device, to the opening and closing device.

In operation, the reversing device reversely opens the case body to deform it into the flat V-shaped form from the semi-open position supported by the supporting rod. Then, the suction device catches and raises the transparent sheet of the case body. Thereby, an insertion space to insert the indication sheet is formed between the case body and transparent sheet.

Then, the bending device bends the indication sheet into the corrugated form and the transfer device inserts the corrugated indication sheet into the insertion space between the case body and transparent sheet. Thereafter, the transfer device withdraws from the insertion space.

In such an indication sheet inserting machine, in case of insertion of the indication sheet into the insertion space, the transverse width of the indication sheet is made smaller by deforming the indication sheet in the corrugated form, thus allowing the indication sheet to be inserted smoothly without interfering with the insertion space of the case.

In the conventional inserting machine, however, in order to form the insertion space in the case for insertion of the indication sheet, the suction device is needed to catch and lift the transparent sheet, which makes the structure of the whole machine complicated.

Additionally, in the conventional inserting machine, as described in lines 28–34, column 9, page 6 of the above-mentioned Japanese patent, when bending the indication sheet into the corrugated form, a lifting rod fixed on the movable plate is utilized. And immediately before the completion of insertion into the insertion space, the indication sheet leaves the lifting rod and returns to the developed condition in the insertion space through its elasticity.

Consequently, according to the conventional machine, when the indication sheet is formed of thin material with poor elasticity, it cannot return to the fully developed condition at the time of the completion of insertion into the insertion space, and the indication sheet somewhat maintains its corrugated form in the insertion space. In such a condition, when the transparent sheet of the case returns to the lower, original position, the indication sheet is sandwiched between the case body and transparent sheet with wrinkles formed thereon. As a result, insertion of the indication sheet cannot be precisely conducted.

The present invention is directed to the above-described problems in the conventional inserting machine, and offers a title sheet inserting machine that can precisely and smoothly insert a title sheet into a case for an optical disk and also has a simpler structure.

SUMMARY OF THE INVENTION

The present invention is directed to a title sheet inserting machine for inserting a title sheet into a foldable case in which an optical disk is loaded. The case includes a case body and a flexible, transparent cover sheet attached on the front surface side of the case body.

In one embodiment of the current invention, the title sheet inserting machine comprises a space forming mechanism to form an insertion space for insertion of the title sheet between the case body and transparent cover sheet, an upper mold or cope that is adapted to be inserted into the insertion space formed by the space forming mechanism, and a lower mold or drag that is placed against the upper mold and adapted to contact with the upper mold. The space forming mechanism transforms the case body in the developed, upwardly facing condition into the flat, inverted V-shape, thereby bending the transparent cover sheet into the flat, general V-shape through its self-weight. The upper mold includes a corrugated contact surface with a plurality of apertures for suction of air or ejection of compressed air for attachment or detachment of a title sheet. The lower mold, which is approachable and recedable relative to the upper mold, includes a corrugated contact surface corresponding to the corrugation of the corrugated contact surface of the upper mold.

In a second embodiment, the space forming mechanism includes a movable suction pad for supporting the case body. The suction pad is adapted to bend the case body into a flat, inverted V-shape.

In a third embodiment, the space forming mechanism includes a holding portion to hold the transparent cover sheet transformed into a flat, general V-shape.

In one embodiment, when inserting a title sheet into the case, first, the space forming mechanism deforms the developed case body into a flat, inverted V-shaped form. Thereby, the flexible, transparent cover sheet provided on the front surface side of the case body bends down into a flat, general V-shaped form through its self-weight. Thus, a generally rhombic insertion space for inserting a title sheet is formed between the case body and transparent cover sheet.

On the other hand, a title sheet is placed between the upper mold and lower mold, which are positioned apart and facing each other. The lower mold approaches and contacts with the upper mold, and thus, the title sheet is sandwiched between the corrugated contact surfaces of the upper and lower molds.

At this time, the corrugated contact surfaces of the upper and lower molds contact tightly with each other and the title sheet is formed into a corrugated form corresponding to the corrugation of the contact surfaces of the upper and lower molds. In addition, the air is drawn into a plurality of apertures on the contact surface of the upper mold, and by this suction, the title sheet is attached on the contact surface of the upper mold.

Then, the lower mold withdraws from the upper mold. At this time, since the air is still drawn into the apertures of the upper mold, the title sheet is still attached on the contact surface of the upper mold.

Thereafter, the upper mold proceeds into the insertion space between the case body and transparent cover sheet. Then, as described above, the title sheet held on the surface of the upper mold is formed into a corrugated shape along the contact surface of the upper mold and thus, the transverse width of the title sheet is made smaller than that of the insertion space. Thereby, the title sheet can be smoothly inserted into the insertion space of the case.

After the completion of the process of moving the upper mold into the insertion space, compressed air is ejected from a plurality of apertures formed on the contact surface of the upper mold. By the pressure of the compressed air, the title sheet is separated from the contact surface of the upper mold. Thereafter, the upper mold recedes from the insertion space. In such a fashion, the title sheet is inserted into the insertion space of the case.

According to a first embodiment of the present invention, in case of forming an insertion space for insertion of a title sheet, because the case body is formed into a flat, inverted V-shape from the developed condition, the transparent cover sheet is easily deformed in a flat, general V-shape through its self-weight, and thus, the generally rhombic insertion space is easily formed between the case body and transparent cover sheet, which eliminates the necessity for providing a transparent cover sheet retaining mechanism for forming an insertion space. In this way, the structure of the whole machine can be simplified.

Moreover, because the compressed air is ejected from the contact surface of the upper mold while a title sheet is placed in the insertion space between the case body and transparent cover sheet, the title sheet can be easily formed into a fully developed condition even if the title sheet is made of thin material with poor elasticity.

In a second embodiment, the space forming mechanism includes a movable suction pad for holding the case body. By moving the suction pad, the developed case body is deformed into a flat, inverted V-shape.

In a third embodiment, the space forming mechanism includes a holding portion for holding the transparent cover sheet deformed into a flat, general V-shape. By holding the transparent cover sheet deformed into a general V-shape, deformation of the transparent cover sheet can be securely maintained.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
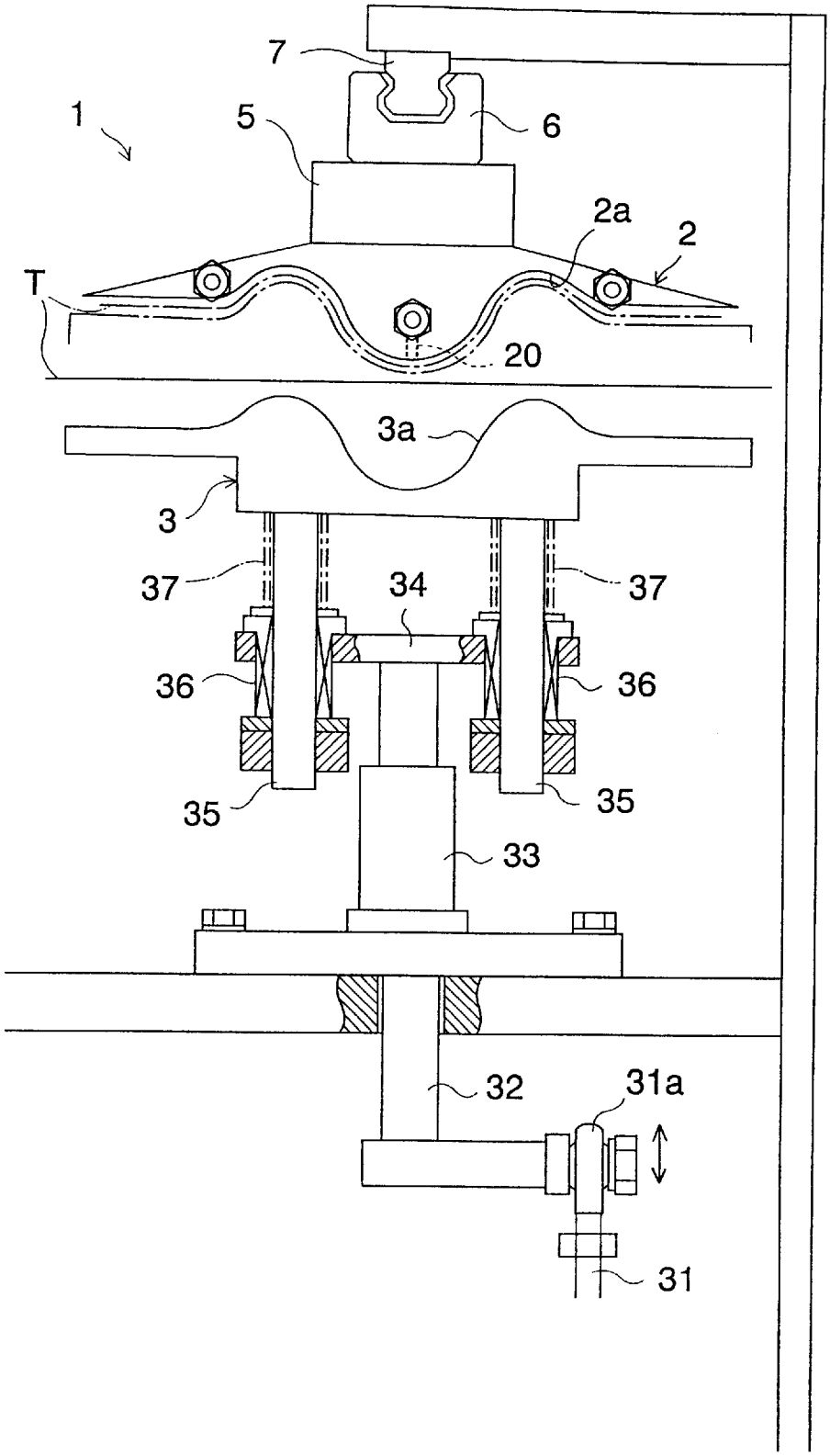
FIG. 1 is a front elevational view of a title sheet inserting machine of the present invention.
Figure 2:
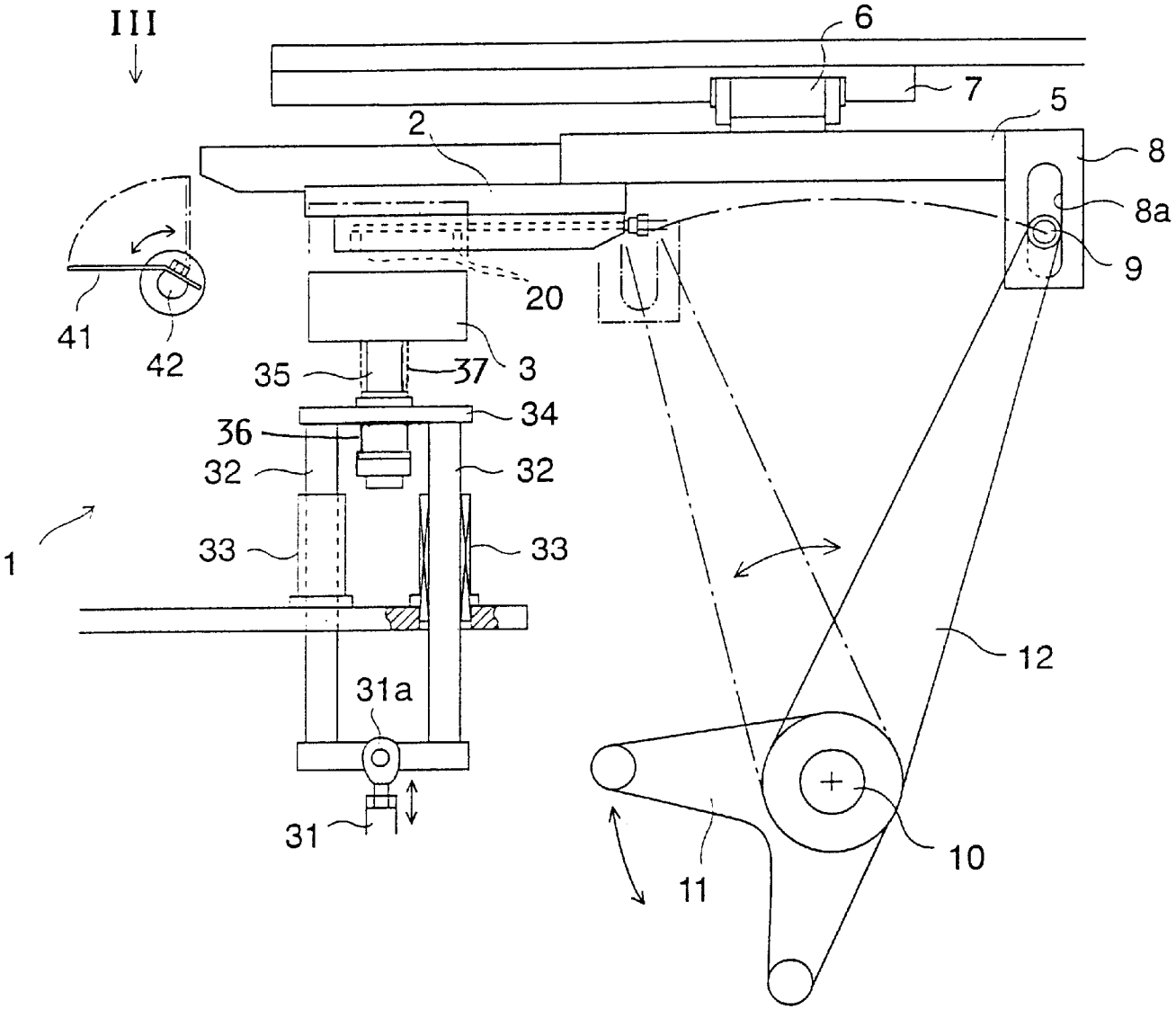
FIG. 2 is a side view of a title sheet inserting machine.
Figure 3:
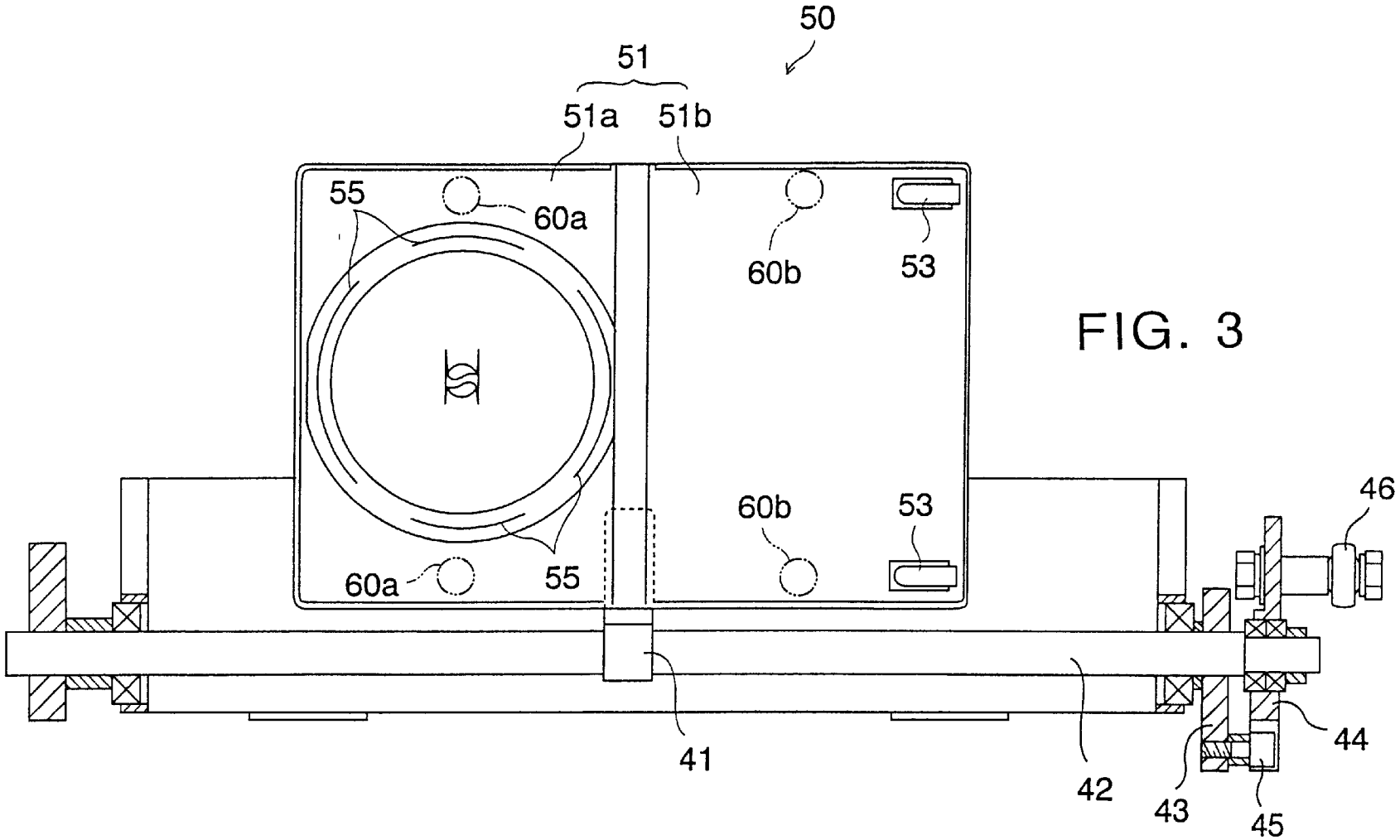
FIG. 3 is a top plan view of a title sheet inserting machine, as viewed from the direction III of FIG. 2.

Referring now to the drawings, FIGS. 1–3 illustrate a title sheet inserting machine of the preferred embodiment of the present invention. As shown in FIG. 1, the title sheet inserting machine 1 comprises an upper mold 2 and a lower mold 3 that are placed apart and against each other in the vertical direction. The upper and lower molds 2, 3 are provided for deforming a title sheet T placed between them into the corrugated form. A corrugated contact surface 2*a* is formed on the bottom surface of the upper mold 2 placed in the upper position, and the corrugated contact surface 3*a* corresponding to the corrugated contact surface 2*a* of the upper mold 2 is formed on the upper surface of the lower mold 3 placed in the lower position. A plurality of apertures 20 are formed on the corrugated contact surface 2*a* of the upper mold 2 for suction of air or ejection of compressed air for attachment or detachment of the title sheet T. These apertures 20 are switchably connected to the vacuum pump or the source of the compressed air (not shown).

As shown in FIGS. 1 and 2, a slide member 5 is connected to the upper portion of the upper mold 2 and a linear guide 6 is connected to the slide member 5. The linear guide 6 is slidably supported by a rail 7 provided over the linear guide 6.

As is clearly shown in FIG. 2, an engagement member 8 is fixed at the end of the slide member 5 and a vertically elongated hole 8*a* is formed on the engagement member 8. On the other hand, under the slide member 5, there is provided a lever 11 rotational around a shaft 10 by the driving force of the driving source (not shown). The shaft 10 is connected to the lower end of an arm 12. A cam follower 9 is provided at the tip end of the arm 12 and it is engaged in the elongated hole 8*a* of the engagement member 8.

When the lever 11 is driven and the arm 12 rotates around the shaft 10, the upper mold 2 slides with the slide member 5 along the rail 7 through the cam follower 9 and the elongated hole 8*a*.

Under the lower mold 3, there is provided a connecting rod 31, which is movable in the vertical direction by the driving force from the driving source (not shown). The rod end 31*a* of the connecting rod 31 is connected to each lower end of a pair of shafts 32 extending in the vertical direction. Each shaft 32 is slidably supported by a bearing 33.

The upper end of each shaft 32 is fixed to a plate 34 into which a pair of vertically extending shafts 35 are inserted. Each shaft 35 is slidably supported by the plate 34 through a bearing 36. The upper end of each shaft 35 is fixed to the bottom surface of the lower mold 3. A spring 37 is provided between the lower mold 3 and each bearing 36.

When the connecting rod 31 moves in the upward direction, the lower mold 3 moves upward through the shaft 32, 35 and comes in contact with the upper mold 2. At the time of this contact, the contact surface 3*a* of the lower mold 3 elastically contacts with the contact surface 2*a* of the upper mold 2 by the action of the spring 37.

Figure 8:
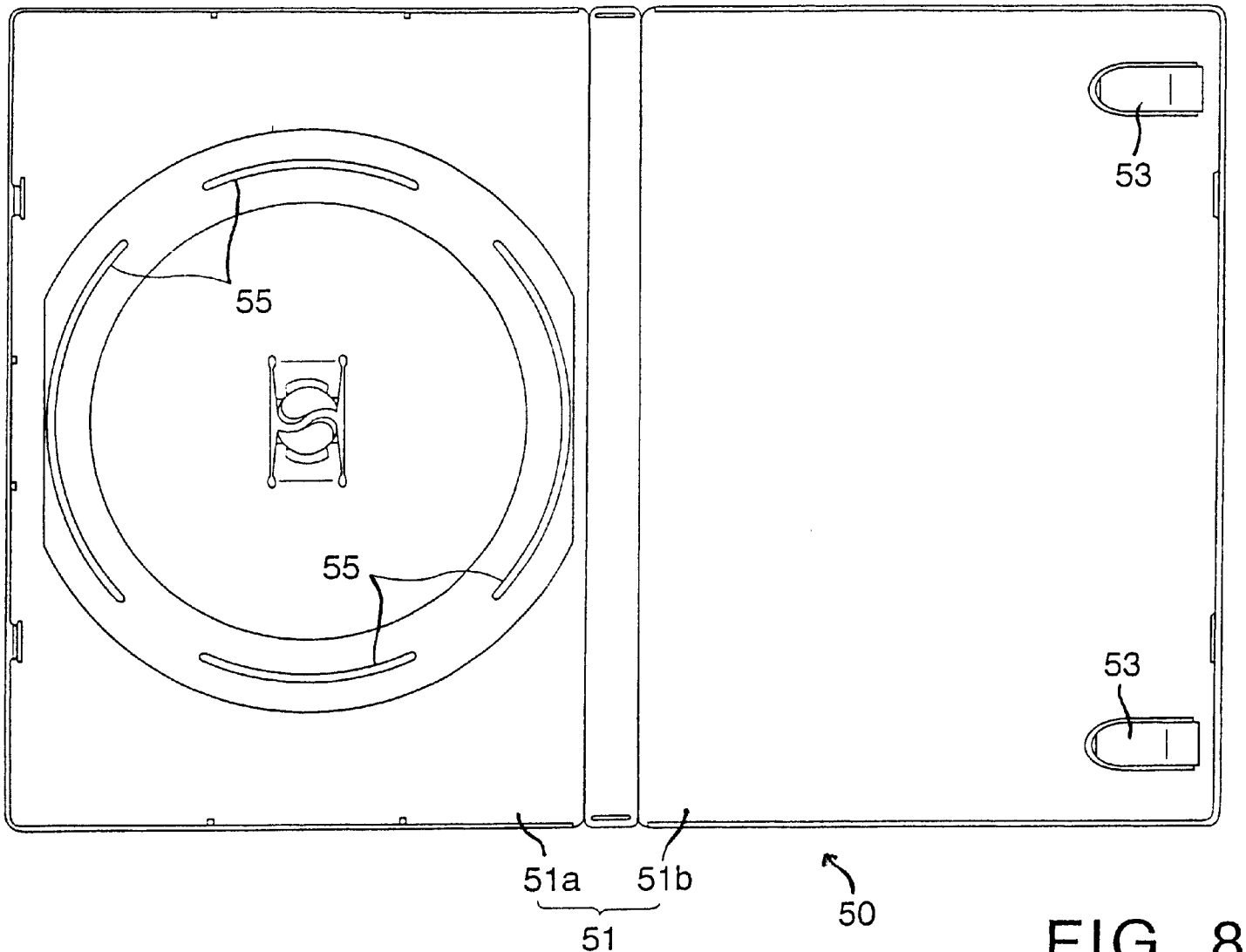
FIG. 8 is a top plan view of a case.
Figure 9:
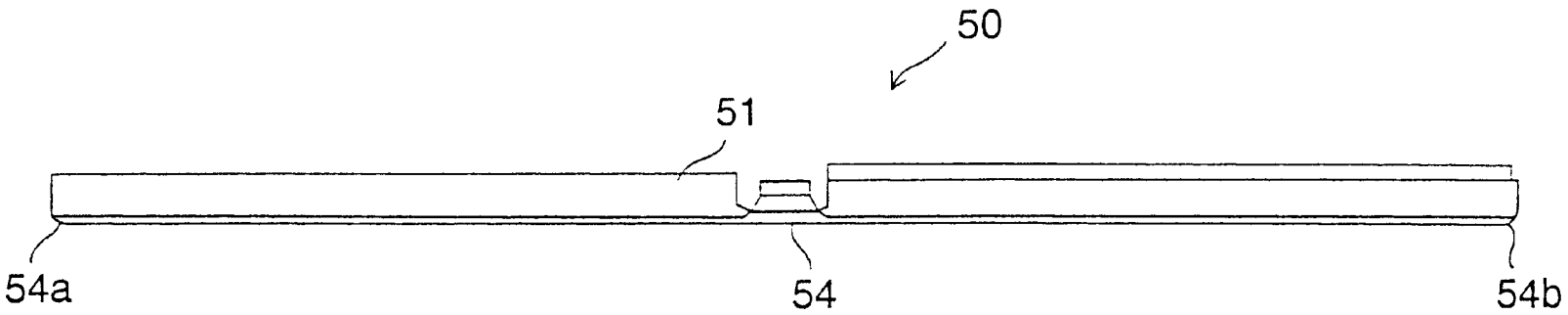
FIG. 9 is a side view of a case.

As shown in FIG. 3, a case 50 into which the title sheet T will be inserted is placed before the upper mold 2. The case 50 is, as shown in FIGS. 8 and 9, a foldable, box-shaped case and comprised of a case body 51 into which an optical disk is loaded and a flexible, transparent cover sheet 54 provided on the front surface side of the case body 51. The case 50 is placed before the upper mold 2 with the inside of the case body 51 facing upwardly.

A plurality of arcuately extending ridges 55 are formed on one face or main body portion 51*a* of the case body 51, and the inner circumference of these ridges 55 defines a recessed seat for loading an optical disk. On the other face or lid portion 51*b* of the case 50, there are provided a pair of claw-shaped holding portions 53 for holding the inserted description sheets and so on. Both ends 54*a*, 54*b* of the transparent cover sheet 54 are bonded to the end portions of the front surface of the case body 51. The body portion 51*a* and the lid portion 51*b* are deflectable or foldable relative to each other, to open and close the case body 51.

Provided movably over the case 50, in its developed condition shown in FIGS. 3, 8 and 9 (i.e. the generally flat condition with the lid portion 51*b* fully open relative to the body portion 51*a*), are two pairs of suction pads 60*a*, 60*b* as a space forming mechanism to form an insertion space in the case 50 for insertion of a title sheet T. The suction pads 60*a* in one row are for attaching and supporting the face or body portion 51*a* of the case body 51 and the suction pads 60*b* in the other row are for attaching and supporting the other face or lid portion 51*b* of the case body 51.

Figure 6:
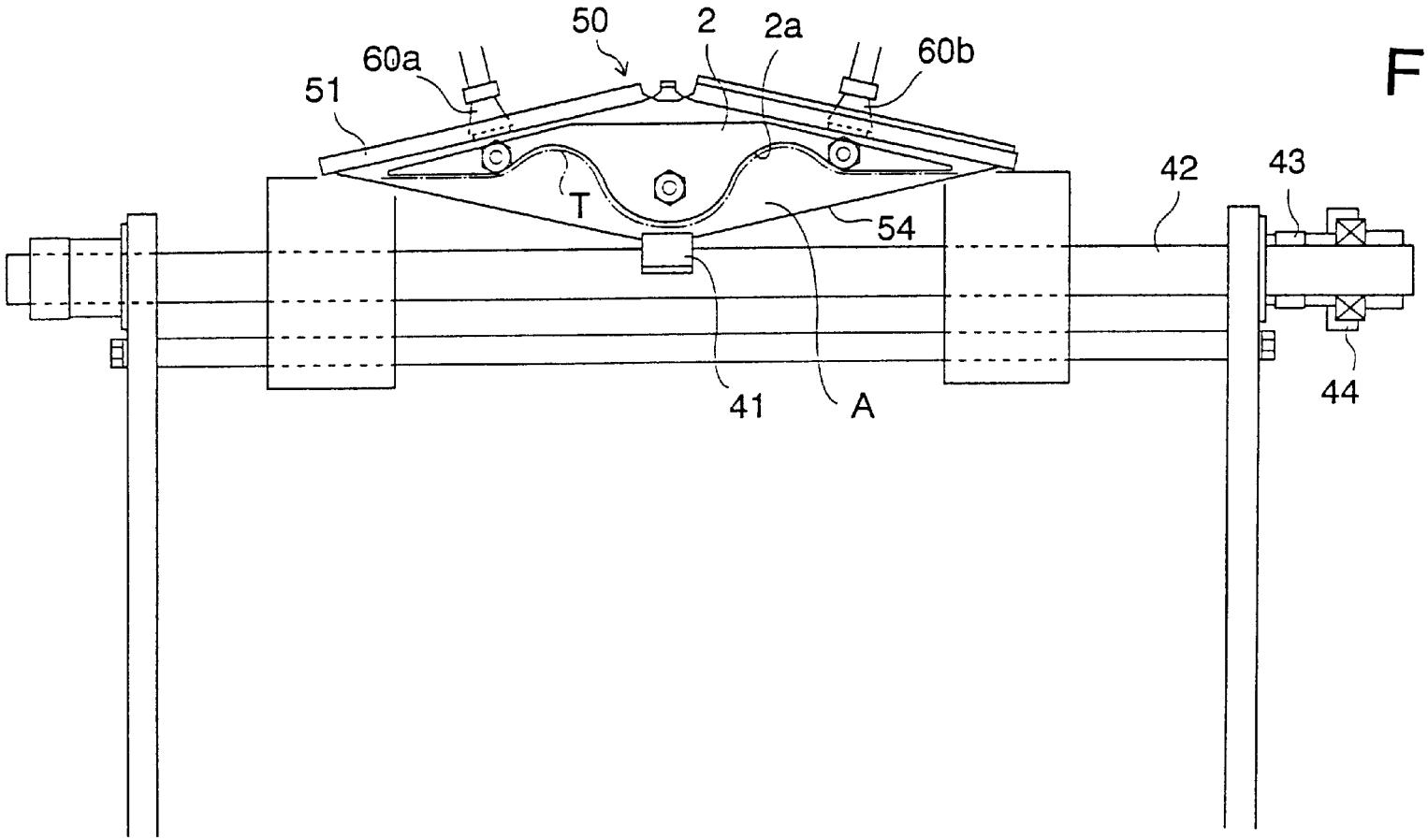
FIG. 6 is a schematic illustrating a deformed title sheet inserted into the insertion space of the case.
Figure 7:
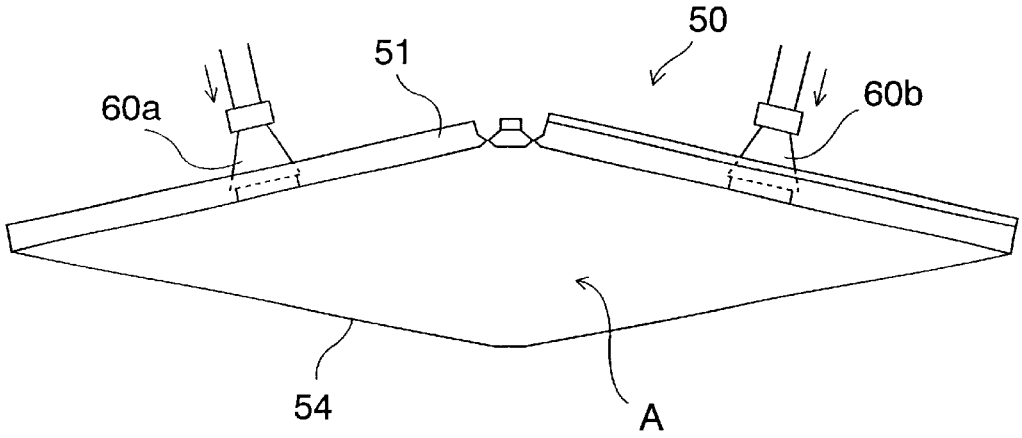
FIG. 7 is a schematic illustrating an insertion space for a title sheet, which is formed by bending the case body into a flat, inverted V-shape.

As shown in FIGS. 6 and 7, when the suction pads 60*a*, 60*b* holding the faces or body and lid portions 51*a*, 51*b* of the case body 51 move downward, the case body 51 deforms into a flat, inverted V-shape and as a result, the transparent cover sheet 54 under the case body 51 bends down into a flat, general V-shape through its own weight, i.e. its self-weight. Thus, an insertion space A for inserting a title sheet T is formed between the case body 51 and transparent cover sheet 54. In addition, other mechanical means may be substituted for the suction pads 60*a*, 60*b*.

In front of the lower mold 3, as shown in FIG. 2, a holding plate 41 is provided to hold a transparent cover sheet 54 that is bent down into a general V-shape. As shown in FIG. 3, the holding plate 41 is fixed to a rotational shaft 42, at one end of which levers 43, 44 are provided. The lever 43 is fixed to the shaft 42 and the lever 44 is rotationally supported by the shaft 42. These levers 43, 44 are connected with each other through a screw 45. There is also provided a connecting rod 46 movable in the vertical direction. The tip end of the connecting rod 46 is connected to one end of the lever 44.

As the connecting rod 46 moves in the vertical direction, the shaft 42 rotates through levers 43, 44 and the holding plate 41 rotates with the shaft 42. As a result, the tip end portion of the holding plate 41 is inserted into the insertion space A of the case 50 and comes in contact with the transparent cover sheet 54 and holds it in place, as shown in FIG. 6. The holding plate 41 is provided as an optional auxiliary device for helping to maintain the insertion space A formed in the case 50, and it may be omitted.

Figure 4:
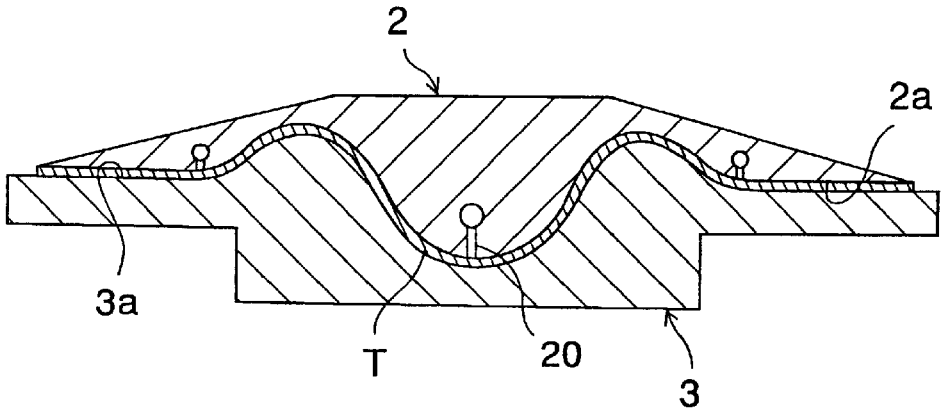
FIG. 4 is a schematic illustrating a title sheet deformed into the corrugated form between the upper and lower molds.

Next, the insertion method by title sheet inserting machine 1 will be described hereinafter. In order to insert the title sheet T into the case 50, first, the title sheet T is placed between the upper mold 2 and lower mold 3 (see the solid line of FIG. 1). Then, by moving the connecting rod 31 upwardly, the lower mold 3 approaches and comes in contact with the upper mold 2 through shafts 32, 35, and the title sheet T is sandwiched between the upper mold 2 and lower mold 3 (see the one-dotted line of FIG. 1 and the sectional representation of FIG. 4).

At this time, the corrugated contact surfaces 2*a*, 3*a* of the upper and lower molds 2, 3 contact tightly with each other and the title sheet T has a corrugated configuration that is formed along the corrugated contact surfaces 2*a*, 3*a*. Also, the air is drawn into a plurality of apertures 20 on the contact surface 2*a* of the upper mold 2 and the title sheet T is attached and held on the contact surface 2*a* of the upper mold 2.

Figure 5:
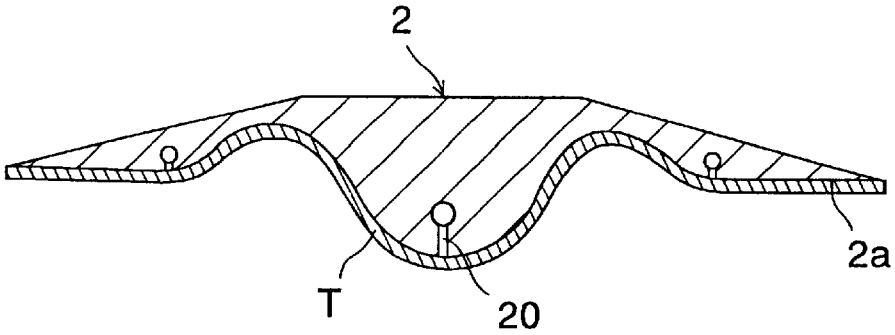
FIG. 5 is a schematic illustrating a title sheet attached on the corrugated contact surface of the upper mold.

Then, by moving the connecting rod 31 downwardly, the lower mold 3 withdraws from the upper mold 2. At this time, because the air is still drawn into the apertures 20 on the contact surface 2*a* of the upper mold 2, the title sheet T is still attached on the contact surface 2*a* of the upper mold 2 even after the lower mold's withdrawal (see FIG. 5). Additionally, in FIGS. 4 and 5, thickness of the title sheet T is shown exaggeratedly for illustration purposes.

On the other hand, the suction pads 60*a*, 60*b* move downward toward the case 50 placed in a developed condition with its case body 51 facing upward and the suction pads 60*a*, 60*b* attach the faces 51*a*, 51*b* of the case body 51 to hold them. In this condition, as the suction pads 60*a*, 60*b* move further downward, the case body 51 deforms into a flat, reversed V-shape (see FIG. 7), and as a result, the transparent cover sheet 54 placed under the case body 51 bends down into a flat, general V-shape through its self-weight. Thus, a general rhombus-shaped insertion space A for insertion of the title sheet T is formed between the case body 51 and transparent cover sheet 54. Then, by rotating the holding plate 41 downward and inserting it into the insertion space A, the tip portion of the holding plate 41 comes in contact with the transparent cover sheet 54 and holds it in a flat, general V-shaped condition.

Thereafter, by driving the lever 11 to rotate the arm 12 in the forward direction, the slide member 5 and upper mold 2 advance toward the case 50. At this time, as above-mentioned, the title sheet T attached on the contact surface 2*a* of the upper mold 2 has a corrugated configuration formed along the corrugated contact surface 2*a* of the upper mold 2. Therefore, the transverse width of the title sheet T is made smaller than that of the insertion space A and thus, the title sheet T, together with the upper mold 2, can be smoothly inserted into the insertion space A between the case body 51 and transparent cover sheet 54 (see FIG. 6).

After insertion of the upper mold 2 into the insertion space A, the compressed air is ejected from a plurality of apertures 20 formed on the contact surface 2*a* of the upper mold 2. By the pressure of the compressed air, the title sheet T attached on the contact surface 2*a* of the upper mold 2 is separated from the contact surface 2*a*. In such a manner, by separating the title sheet T from the contact surface 2*a* of the upper mold 2 through the pressure of the compressed air, even if the title sheet T is comprised of thin material with poor elasticity, the title sheet T can be easily placed in a fully developed condition after separation from the upper mold 2. Thus, insertion of the title sheet T into the insertion space A can be conducted precisely.

After separation of the title sheet T from the upper mold 2, by driving the lever 11 to rotate the arm 12 in the backward direction, the upper mold 2 withdraws or recedes from the case 50. In addition, after withdrawal or recession of the upper mold 2 from the insertion space A, the holding plate 41 rotates upward. Then, by moving the suction pads 60 in the upward direction, the case body 51 returns to the horizontal condition shown in FIG. 9 from the flat, inverted V-shaped condition, and the title sheet T is sandwiched between the case body 51 and transparent cover sheet 54. At this time, the title sheet T is in a fully developed condition by the action of the compressed air and as a result, wrinkles never occur in the title sheet T inserted in the case 50. In such a way, the title sheet insertion process is completed.

According to the embodiment of the present invention, because the title sheet T is inserted into the insertion space A with its configuration deformed into a corrugated form and its transverse width made smaller, insertion of the title sheet T can be smoothly conducted without interfering with the transparent cover sheet 54.

Furthermore, in forming the insertion space A in the case 50, because the case body 51 is deformed into a flat, inverted V-shape from the upward facing condition, the transparent cover sheet 54 easily bends down into a flat, general V-shape through its self-weight and thus, the insertion space A for insertion of the title sheet T is easily formed between the case body 51 and transparent cover sheet 54. In this way, the transparent cover sheet retaining mechanism is not necessary for forming the insertion space, which can simplify the whole structure of the machine.

Moreover, in placing the title sheet T in the insertion space A between the case body 51 and transparent cover sheet 54, because the compressed air is ejected from the contact surface 2*a* of the upper mold 2, the title sheet T can be easily returned to the developed condition even if it is made of thin material with poor elasticity and thus, the title sheet T can be precisely inserted into the case 50.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A title sheet inserting machine for inserting a title sheet into a foldable case adapted to receive an optical disk therein, wherein said case includes a case body having a body portion and a lid portion foldably connected to said body portion, and a flexible transparent cover sheet provided on an outer surface of said case body, and wherein said title sheet inserting machine comprises:

a space forming mechanism adapted to deform said case body by relatively unfolding said lid portion and said body portion into an inverted V-shape with said outer surface facing downwardly, and to bend said cover sheet into a general V-shape hanging downwardly from said case body at least partly due to a self-weight of said cover sheet, so as to form an insertion space between said case body and said cover sheet;

an upper mold having a corrugated first contact face with air apertures therein, wherein said air apertures are adapted selectively to have suction applied thereto for suction-holding a title sheet on said first contact face and to have compressed air provided thereto for releasing said title sheet from said first contact face, and wherein said upper mold is movable relative to said space forming mechanism so that said upper mold is insertable into said insertion space; and a lower mold that is positioned opposite and facing said upper mold, that has a corrugated second contact face with a corrugation corresponding inversely to said corrugated first contact face of said upper mold, and that is relatively movable toward and away from said upper mold.

2. The title sheet inserting machine according to claim 1, wherein said space forming mechanism includes a pair of movable suction pads that are adapted to support said case body by suction and that are movable so as to bend said lid portion and said body portion of said case body relative to each other into said inverted V-shape.

3. The title sheet inserting machine according to claim 2, wherein said space forming mechanism further includes a holding member arranged and adapted to hold said cover sheet away from said case body with said cover sheet in said general V-shape.

4. The title sheet inserting machine according to claim 1, excluding a suction device for lifting said cover sheet.

5. The title sheet inserting machine according to claim 1, excluding any device for moving or for holding said cover sheet away from said case body.

* * * * *